United States Patent [19]

Lynch

[11] 4,332,762

[45] Jun. 1, 1982

[54] PROCESS FOR PREPARING A SPREADABLE ACRYLIC FIBER TOW

[75] Inventor: Charles E. Lynch, Camden, S.C.

[73] Assignee: E. I. Du Pont de Nemours and Company, Wilmington, Del.

[21] Appl. No.: 101,798

[22] Filed: Dec. 10, 1979

Related U.S. Application Data

[63] Continuation of Ser. No. 681,592, Apr. 29, 1976, abandoned.

[51] Int. Cl.[3] ..... D01D 5/22

[52] U.S. Cl. ..... 264/168; 264/171; 428/373

[58] Field of Search ..... 264/171, 168; 428/373

[56] References Cited

U.S. PATENT DOCUMENTS

| | | | |
|---|---|---|---|
| 3,038,238 | 6/1962 | Wu | 28/82 |
| 3,039,524 | 6/1962 | Belck et al. | 28/82 |
| 3,264,705 | 8/1966 | Kovarik | 28/76 |
| 3,463,846 | 8/1969 | Nakagawa | 264/168 |
| 3,624,195 | 11/1971 | Nakayama et al. | 264/168 |
| 3,663,676 | 5/1972 | Lulay | 264/168 |
| 3,737,504 | 6/1973 | Herrbach et al. | 264/168 |
| 4,071,596 | 1/1978 | Davis | 264/168 |

FOREIGN PATENT DOCUMENTS

| | | | |
|---|---|---|---|
| 42-2938 | 2/1967 | Japan | 264/171 |
| 48-28980 | 9/1973 | Japan | 264/171 |
| 6612187 | 3/1967 | Netherlands | 264/171 |

*Primary Examiner*—Jay H. Woo

[57] ABSTRACT

Tows of highly entangled, continuous, eccentric bicomponent acrylic filaments in which the filaments have a density of about 1.0–1.17, an equilibrium crimp reversibility (ECR) of at least about 20% and a filament entanglement value greater than about 12 and less than about 60 are provided by drying previously undried tows of continuous acrylic filaments having an eccentric bicomponent structure in which a large difference exists between the hot water swellability of the components of the filaments, as indicated by their ECR, to a maximum moisture content of about 3% by weight of the filaments at a temperature below the hot-wet glass transition temperature of the fiber polymers.

2 Claims, 2 Drawing Figures

PROCESS FOR PREPARING A SPREADABLE ACRYLIC FIBER TOW

This is a continuation of application Ser. No. 681,592, filed Apr. 29, 1976, now abandoned.

This invention relates to tows of highly entangled continuous bicomponent acrylic filaments and a process for preparing them.

In order to be processible into staple fiber yarns for conventional textile purposes, tows of bicomponent acrylic filaments should have low bicomponent crimp and entanglement. In addition, acrylic fibers of low density are disadvantageous for conventional textile uses because they absorb high quantities of dye and finish and provide low visible dye yields due to the presence of voids in their structure. For these reasons, the processing conditions under which bicomponent acrylic tows are made are controlled to avoid excessive crimp development and to insure high fiber density (compaction). In the case of "squirming" bicomponent fibers where one component swells reversibly more than the other in hot water, the filaments as produced are relatively straight but have a latent crimping potential which can be developed advantageously in after-treatments. Thus, high crimp can be developed in yarns and garments prepared from such filaments after textile processing by relaxing treatments, such as boil-off, dyeing or steaming followed by tumble drying. As an example of how low crimp, high density fibers can be prepared from this type of bicomponent acrylic tow, U.S. Pat. No. 3,264,705, issued to Kovarik on Aug. 9, 1966, describes a taut steaming process. However, in Example 3, Item E, Kovarik teaches that relaxed steaming can lead to staple fibers of low density after boil-off treatment, which are labelled undesirable. In no case does Kovarik deal with continuous filament tows of low density "squirming" bicomponent acrylic filaments. On the other hand, conventional unbonded continuous filament tows to which crimp has been imparted by ordinary methods are generally incapable of being spread into uniform, substantially split-free webs.

SUMMARY OF THE INVENTION

It has now been found that tows of highly entangled continuous eccentric bicomponent acrylic filaments in which the filaments have a density of about 1.0–1.17 g/cc, an equilibrium crimp reversibility (ECR) of at least about 20%, preferably 20–60%, and filament entanglement value greater than about 12 and less than about 60 can be prepared by drying a previously undried tow of continuous acrylic filaments having an eccentric bicomponent structure in which a large difference exists between the hot water swellability of the components of the filaments, as indicated by their ECR, to a maximum moisture content of 3% by weight of the filament weight at a temperature below the hot-wet glass transition temperature ($T_g$) of the fiber polymers; that is, drying is carried out at a temperature below the highest of the fiber polymer $T_g$ values, generally at 30°–80° C. The specified tow properties can be achieved even without pre- and/or post-drying treatment of the filaments.

Previously undried continuous eccentric bicomponent acrylic filament tows which are dried in accordance with this invention develop a level of bulk which exceeds the amount of bulk which can be developed by any other drying technique. In addition, because of the high degree of entanglement of the filaments in the tow, the tows can be spread into substantially uniform, split-free and integral webs having a width at least 10 times that of the tow. Such webs may also be stabilized by stitch bonding, hydraulic needling or any other method known in the art. Further, because no additional hot relaxation or steam treating step is necessary to develop crimp, bulk and spreadability in the tows of this invention, the present process presents a significant economic advantage.

DRAWINGS

DETAILED DESCRIPTION OF THE INVENTION

Figure 1:
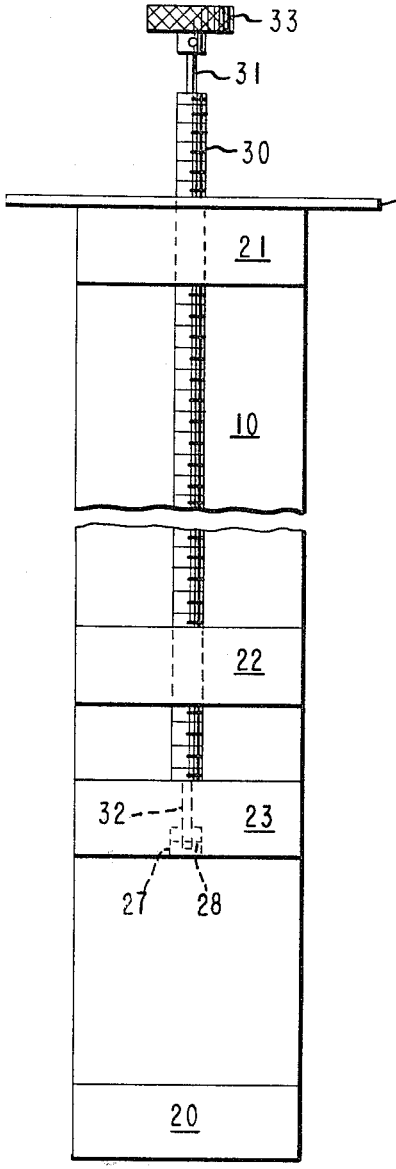
FIG. 1 is a front elevational view of a holder used to measure ECR.
Figure 2:
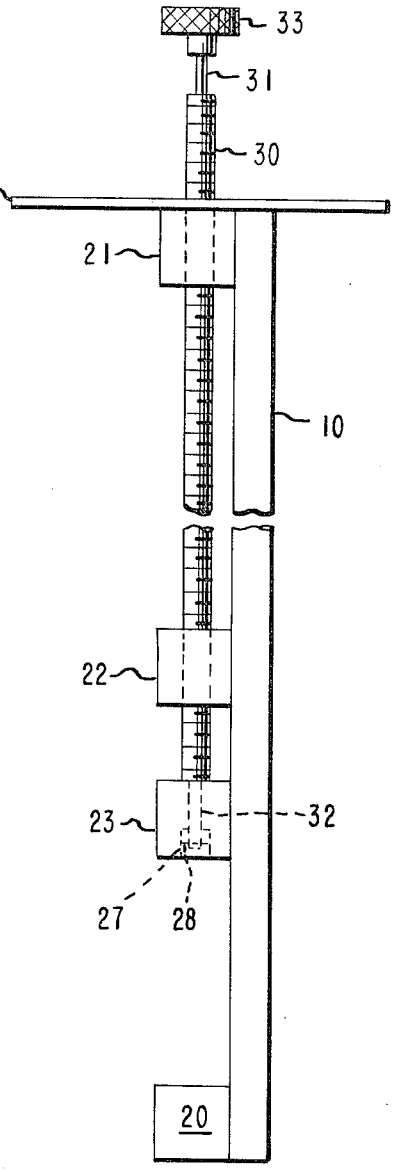
FIG. 2 is a side elevational view of a holder used to measure ECR.

The spreadable tows of this invention achieve their characteristic highly entangled nature by virtue of the specific type of drying operation employed on a specific type of continuous filament in the tow. The degree of lateral cohesion which provides spreadability depends on the number of entanglements in the tow, which is, in turn, believed to be due to the high shrinkage-modulus conditions under which the crimp develops. That is, the shrinking forces are large enough to overcome the restraint imposed by closely adjacent filaments, which restraint builds as crimp develops. Hence, crimp development is the means by which the entanglements are formed. That the filaments in the tows are highly entangled is indicated by a filament entanglement value greater than about 12 and less than about 60, preferably about 20–40. The filament entanglement test described hereinafter measures the strength of the filament entanglements which gives the tows and the webs formed therefrom their lateral strength and cohesion. At a filament entanglement below about 12, the tow splits while being spread and does not provide a web that can be worked; at about 60 and higher, no greater uniformity or spreadability is achieved. In addition, increasing degrees of entanglement at about 60 and above require correspondingly increased amounts of work to spread the tows into webs and introduce the possibility that some filaments may be broken when the tow is spread. At fiber entanglement values of 20–40, optimum spreadability into uniform webs is obtained with minimum filament breakage.

The dried filaments must have a density of about 1.0–1.17 g/cc, preferably about 1.14–1.16 g/cc. Filaments having a density in this range have higher ECR characteristics than are attainable in fibers prepared from the same polymeric compositions at normal high densities. While the filaments can have a density lower than 1.0, it is not practical to make or use such filaments commercially. However, a density of about 1.0–1.17 g/cc is necessary in order to obtain the advantages of this invention. If the dried filaments have a density greater than about 1.17 g/cc, then the drying temperature was too high to permit the adequate development of crimp during drying to sufficiently entangle the filaments in the tow, as explained hereinafter. Optimum crimp development and entanglement are developed within the preferred range of about 1.14–1.16 g/cc.

The tow must be made up of continuous acrylic filaments having an eccentric bicomponent structure in which a large difference exists between the hot water swellabilities of the two components as described in U.S. Pat. No. 3,092,892 issued to Ryan et al. on June 11, 1963 and indicated by the ECR of the filament. By "hot" water is meant that the water has a temperature in the region of from about 70° C. up to about the boiling point of water. A higher ECR reflects a higher differential between the dry and wet length of the filament components. While the filaments can have an ECR higher than about 60%, such filaments are not easily prepared on a commercial basis. However, a minimum ECR of about 20% is necessary to obtain the minimum differential in the swellability of the filament components which will provide adequate crimp development to sufficiently entangle the filaments in the tow. Filaments having an ECR of about 20–60% exhibit pronounced differential crimp changes ("squirm") on drying. This arises because the filaments comprise two components in a substantially eccentric relationship in the sense that the cross sections of the components have center points that do not coincide. Such filaments generally develop a pronounced helical crimp on relaxed exposure to conditions that permit relief of stresses imparted during their manufacture. Within a most preferred range of ECR of about 30–50%, optimum helical crimp is developed on drying, thus providing optimum entanglement and spreadability.

Preferred tows, particularly those containing 10,000 or more filaments, also have a high degree of lateral cohesion that permits spreading to lightweight webs without the splits that occur on spreading prior art tows. At less than about 1,000 filaments, the tows are too small to develop an adequate degree of filament entanglement to provide the uniform spreadability of the tows of this invention. Nevertheless, these smaller tows have a degree of bulk and elasticity which is difficult to achieve in tows of similar but more compacted filaments. This bulk and elasticity makes such smaller tows particularly useful as knitting or craft yarns.

The eccentric bicomponent filaments of this invention develop a high helical crimp amplitude, and therefore have a high crimp index when dried in accordance with this invention. A crimp index of about 10–40, preferably about 20–30, characterizes the filaments in the preferred tows of this invention. The higher crimp amplitude is believed to enhance entanglements. At a crimp index of about 20–30, optimum crimp amplitude to provide concomitantly optimum entanglement and spreadability is obtained. Filaments in the preferred tows of this invention also have a crimp frequency of about 2–15 crimps/cm of extended filament length. When the more hot water swellable component is situated on the inside of the crimp helices, the filament loses some of its crimp under hot-wet conditions and regains it on drying. The reverse occurs when the more hot water swellable component is on the outside of the crimp helices. Hence, when the more hot water swellable component is on the inside in the dry state, adequate crimp development occurs on drying and the filaments have a positive ECR.

The prior art teaches that both copolymers and polymer mixtures can be used to adjust the level of the hot water swellability of the components of a bicomponent filament. For example, hot water swellability is enhanced by incorporating in the component filament polymers units of ionizable monomers which confer dye receptivity to the polymers as illustrated in U.S. Pat. Nos. 3,038,237; 3,029,524 and the like. Non-ionic monomers that confer hot water swellability to the filament components are illustrated in U.S. Pat. Nos. 3,400,531; 3,470,060; 3,624,195; 3,719,738 and the like. Blends of an acrylic polymer and a highly hot water swellable polymer can also be used as discussed in U.S. Pat. No. 3,038,239. The composite filaments described in U.S. Pat. No. 3,092,892 are eminently suitable for use in the practice of this invention.

Any two polymeric components disclosed in the patents referred to above which have a substantial difference in hot water swellability can be used to make the eccentric bicomponent acrylic filaments to be used in the practice of this invention with the proviso that the components possess a difference in hot water swellability which provides the filaments with an ECR of at least about 20%, preferably about 20–60%. Two or more polymers may also be employed as one or each of the two components.

Preferred polymers which can function as the filament component having higher hot water swellability include those comprising (1) about 85–98% by weight of units derived from acrylonitrile; (2) about 2–10% by weight of units derived from one or more of styrenesulfonic acid (o-, m-, p-isomer), allylsulfonic acid, methallylsulfonic acid, vinylsulfonic acid, or their metal-, ammonium- or amine salts, a vinyl pyridine such as 2-vinyl pyridine or 2-methyl-5-vinyl pyridine, vinyl pyrrolidone, acrylamide, methacrylamide, hydroxymethyl acrylamide and the like and mixtures thereof and (3) 0 to about 13% by weight of units derived from any other monomer known in the art which is copolymerizable with acrylonitrile and which is less hydrophilic than units of a monomer of (2), including methyl acrylate, methyl methacrylate, vinyl acetate, methacrylonitrile and the like and mixtures thereof.

Preferred polymers or blends of polymers which can function as the filament component having lower hot water swellability include those comprising (A) about 80–100% by weight of a polymer comprising about 85–100% by weight of units derived from acrylonitrile and 0 to about 15% by weight of units derived from a monomer copolymerizable with acrylonitrile and which is less hydrophilic than a monomer of (2) below including methyl acrylate, methyl methacrylate, vinyl acetate, methacrylonitrile and the like and mixtures thereof, and (B) about 20–0% by weight of a polymer comprising (1) about 85–98% by weight of units derived from acrylonitrile; (2) about 2–10% by weight of units derived from one or more of styrenesulfonic acid (o-, m- or p-isomer), allylsulfonic acid, methallylsulfonic acid, vinylsulfonic acid, or their metal-, ammonium or amine salts, a vinyl pyridine such as 2-vinyl pyridine or 2-methyl-5-vinyl pyridine, vinyl pyrrolidone, acrylamide, methacrylamide, hydroxymethyl acrylamide and the like and mixtures thereof and (3) 0 to about 13% by weight of units derived from any other copolymerizable monomer known in the art which is less hydrophilic than units of a monomer of (2), including methyl acrylate, methyl methacrylate, vinyl acetate, methacrylonitrile and the like and mixtures thereof.

Filament tows prepared as described in the patents mentioned herein reach most of their full helical crimp capability during drying at a temperature below the hot-wet glass-transition temperature ($T_g$) of the filament polymers. Typically, more crimp than is achieved with high-temperature dried filaments only after boil-off or steaming after-treatments is developed in the tows of this invention when they are dried at a temperature below the $T_g$ of the filament polymers, without the need for such after-treatment. However, even higher crimp can be achieved in the low density filaments of the tows of this invention by such after-treatments, especially if carried out under little restraint, as when boiling off chips of cut tow. In addition, the density of the dried filaments is strictly dependent on the drying temperature. Generally, temperatures of about 30°-80° C., preferably about 50°-70° C., are used depending on the polymer structure, the degree of orientation and the kind of treatment to which the undried filaments have been subjected which might change the $T_g$ of the polymer in the filaments. The preferred range provides optimum results in terms of time and cost. At temperatures above the $T_g$ of the filament polymers, preferably a maximum of about 80° C., the water escapes while the filament is too limp to develop adequate crimp and entanglement, and the filament structure can compact, resulting in a high density filament. At temperatures much below about 30° C., the drying operation is commercially undesirable since it requires a very high flow of the drying medium and a long hold up time. Air or any other gas inert to the filaments may be used as the drying medium. On the other hand, a solvent that extracts water may be used or a vacuum may be applied.

Surprisingly, continuous acrylic bicomponent filament tows prepared by the operation of this invention have a bulk and spreadability which exceeds those that can be developed by any other drying technique, even without additional physical or mechanical treatment of the filaments. Such additional treatments may also be employed to further optimize the properties of the tows of this invention, if desired, including steaming, boil-off and so on. In any event, uniform, split-free webs can be produced even when the tows of the invention are spread at least 10× their width. While the orientation of the fibers in a web may appear largely random, generally some degree of orientation predominates, depending on the extent to which the tow has been spread. At maximum spread, the orientation of the fibers approaches 90° with respect to the alignment of the filaments in the original tow direction. The webs are comparatively strong in the width as well as length direction, due to strong interfilament entanglements. Further, the webs have good flexibility, drape and elasticity, probably due to the crimp between entanglements. The webs can be stabilized and/or plied into heavier webs, optionally with entanglement of the plies by means available in the art, such as mechanical, pneumatic or hydraulic needling, resin bonding, "solvent bonding" and the like. The lamination of several webs followed by needling or other interlaminating bonding provides felt-like structures.

The omnilateral strength and elasticity and good recovery from stretch of such webs, taken with the excellent resistance of acrylic fibers to sunlight, mildew and chemicals, admirably suit such webs for such uses as the "warp" of stitch-bonded fabrics, the base for vinyl-coatings (for luggage, upholstery, pond liners, athletic pad covers, and the like), media for a wide range of wet- and dry-filtration processes, sweat bands, shoe linings and cushions, road support, beach erosion control, boat sails, horticultural applications (such as bird screens for fruit trees, arbors and tobacco cloth), tufting substrates, awnings, tents, tarpaulins and a variety of covers especially suitable for marine use, draperies, upholstery, lightweight blankets, fillings, bandages, hospital pads, felts such as papermaker's felt, abrasive fabrics and tennis ball covers. The increased squirm of the low-density filaments of this invention can further be used advantageously in continuous filament yarns and fabrics.

Nonwoven sheets consisting essentially of the continuous-filament aggregates of this invention are suited for use in the manufacture of flameproof fabrics in accordance with the process of U.S. Pat. No. 3,027,222, issued to Wilkinson on Mar. 27, 1962. The Wilkinson patent teaches a process for pyrolysis of acrylonitrile-polymer filaments into a structure of limited bulk density by programmed temperature increases, thereby preserving a larger proportion of fiber strength than other pyrolysis processes by avoiding insulated spaces in which the exothermic pyrolysis reaction can overheat. The unusually uniform, bulky structure of webs prepared from the tows of this invention is easily ventilated in the patented process, and the pyrolyzed structure is uniformly strong.

TEST METHODS

Equilibrium Crimp Reversibility (ECR)

Tows of dried, crimped filaments to be tested are cut to chips of about 10 cm crimped length and the chips are given a relaxed, 30-minute boil-off loosely wrapped in a single thickness of cheesecloth. They are dried for 30 minutes in an oven at 70° C.

Fibers are selected randomly from the boiled off and dried chips and mounted in holders designed to measure ECR as illustrated in the Figures in which like numerals refer to the same element. In the figures, holder base 10 is a sheet of black plastic about 3.8 cm wide, 0.6 cm thick and 20 cm long. Three blocks of aluminum 20, 21 and 22 about 1.3 cm square and 3.8 cm long are firmly attached to one face of the base. The first block 20 is attached across the bottom end of base 10. Another block 21, attached across the top end of base 10 is drilled through its center and parallel to the length of base 10 to just allow an 18 cm long, fully threaded rod 30, approximately 0.6 cm in diameter to pass through. The third block 22 is drilled similarly to block 21, except that it is threaded and positioned about 8 cm above bottom block 20. The diameter of rod 30 is reduced on a lathe at each end 31, 32 to about 0.3 cm for a length of about 0.8 cm. A knurled knob 33 is securely attached to end 31. A fourth aluminum block 23 of the same dimensions as the three mounted blocks is movable and is drilled from the center of one face to pass freely end 32 of threaded rod 30. From one face the hole is counterdrilled to give a counterbore 27 of about 0.6 cm diameter and about 0.7 cm depth, leaving a flat bottom. A disc of aluminum 40 about 0.16 cm thick and about 6.3 cm in diameter is drilled through its center to pass the threaded rod and is firmly attached to the top of aluminum block 21 to serve as a hanger for the holder.

The apparatus is assembled by passing the free end of threaded rod 30 through aluminum disc 40 and top block 21, screwing it through threaded block 22, and passing end 32 through the loose block 23 so that it terminates in counterbore 27 where it is secured with compression washer 28, leaving enough clearance to permit free turning of rod 30. By turning knob 33, movable block 23 is positioned approximately 5 cm from bottom block 20.

One end of each of five boiled-off and dried fibers is taped to movable block 23. The other ends are then taped to bottom block 20 after pulling out slack but not crimp, using care to leave about the same crimped length of fibers between the blocks. Holder base 10 is labeled to identify the sample, and movable block 23 is moved down to provide definite slack in the fibers.

When the required number of fibers have been loaded into holders, the required number of the holders are placed for at least 30 minutes in a glass-walled bath of water maintained at 70° C. Movable block 23 of each holder is moved upward to remove slack from the fibers, and the wet crimp therein counted using a cathetometer; each convexity on one side of the fiber is regarded as a crimp.

The holders are removed from the bath; fiber slack is re-established by moving block 23 downward; the holders are placed in a 70° C. oven for about thirty minutes and then stored at room temperature (about 21° C., 65% relative humidity) for 30 minutes. Dry crimps are counted as described above after removing slack.

$$ECR = \frac{(\text{No. of crimps dry} - \text{No. of crimps wet})}{\text{No. of crimps dry}} \times 100\%$$

Determinations on about 100 fibers are required for good reliability.

Filament Entanglement Test

A length of tow is spread laterally to a web having a weight of about 20 g/m$^2$ and the web is cut into two lengths which are placed, one on top of the other in parallel orientation, and not cross-lapped, to prepare a composite web. Square (15 cm×15 cm) samples are cut from the composite web and weighed. Each sample is marked with ink at two points, 2.5 cm from the centers of opposite edges such that the two points are 10 cm apart along the longitudinal fiber direction in the web.

The eye end of a hook (Oshaughnessy size 6/10 fish hook with the barb ground off or a hook of similar design and size) is attached by a small chain to hang perpendicularly from the load cell of the "Instron" tester. This hook is inserted through one marked point on the composite web.

A second hook is inserted through the other marked point on the sample and the eye end of the hook is attached by a small chain to the crosshead of the Instron.

The Instron tester is set to pull the hooks apart at a rate of 20 cm per minute while the resistance force of the sample is recorded in grams. The maximum resistance force in grams recorded before the sample pulls apart, divided by the material weight in grams, is the filament entanglement value. The average of three determinations is reported.

Crimp Frequency

This value is measured on individual fibers from a tow and is the average of measurements on at least 10 fibers. After counting the crimps in the fibers having a crimped length of 5 cm or more, the crimp is removed by extending the fiber to its full uncrimped length. The extended length is measured.

Crimp frequency (Crimps/cm)=No. of crimps/extended fiber length (cm)

*Crimp Index* is defined as the difference between the fiber length when the fiber is extended to just remove the crimp and the crimped fiber length, expressed as a percentage of the extended fiber length:

$$CI = \frac{\text{Extended fiber length} - \text{crimped fiber length}}{\text{Extended fiber length}} \times 100\%$$

*Intrinsic Viscosity* is the limit of the natural logarithm of the ratio of the flow time of a dilute-solution of a polymer to solvent flow time as the polymer concentration approaches zero. The solvent is 0.2-molar solution of lithium bromide in dimethylformamide. The temperature at which the measurements are made is 25° C.

*Density* is determined in carbon tetrachloride/heptane density gradient tubes prepared as known in the art. The range from 1.00 to 1.22 g/cc is covered by two tubes (standard 250 ml graduated cylinders). For the first, the following "stock" solutions are prepared from well-dried solvents:

| ml | | |
|---|---|---|
| $CCl_4$ | heptane | Approx. density |
| 27 | 56 | 0.980 |
| 29 | 54 | 1.002 |
| 31 | 52 | 1.023 |
| 33 | 51 | 1.041 |
| 34 | 49 | 1.056 |
| 36 | 47 | 1.077 |
| 38 | 45 | 1.099 |
| 40 | 43 | 1.120 |

The second is prepared from the following "stock" solutions:

| ml | | |
|---|---|---|
| $CCl_4$ | heptane | Approx. density |
| 38 | 45 | 1.099 |
| 40 | 43 | 1.120 |
| 42 | 42 | 1.137 |
| 43 | 40 | 1.153 |
| 45 | 38 | 1.174 |
| 47 | 36 | 1.196 |
| 49 | 34 | 1.217 |
| 51 | 33 | 1.232 |

To prepare the tubes, 30 ml of the densest stock solution is poured into a 250-ml graduate, followed by 30 ml of the next lighter solution, and the others in turn, until 30 ml of each of the solutions has been added. The second and all subsequent additions are made slowly though a pipette, holding the tip near the wall of the cylinder, to avoid mixing. The two cylinders are placed in a water bath controlled at 25°±0.1° C. and clamped securely in a vertical position. The tubes are stoppered except when making additions or removals.

Calibrated glass floats (obtained from Scientific Glass Apparatus Co., Bloomfield, N.J.) selected to have densities spanning the range to be measured are added and allowed to remain in the cylinders during use. A graph calibrating density vs. height is prepared using the calibrated floats.

A small bundle of filaments (<10 filaments) is tied into a loose knot and the ends clipped off. The knot is placed in the tube and allowed to equilibrate at least an hour (the fiber must not touch any solid surface while equilibrating). The position of the knot in the tube is then read at half-hour intervals until two consecutive readings are the same. The density is determined by reading the density corresponding to the stable height from the graph calibrating density vs. height.

The invention is further illustrated but is not intended to be limited by the following examples in which all parts and percentages are by weight unless otherwise specified.

EXAMPLE

A 24% solution of dimethylformamide of 85 parts of a polyacrylonitrile polymer having an intrinsic viscosity of 2 and 15 parts of a copolymer having an intrinsic viscosity of 1.5 and containing 95.5% of units derived from acrylonitrile and 4.5% of units derived from sodum styrenesulfonate is spun side-by-side with a 31% solution of the copolymer in dimethylformamide essentially as taught in Example 1 of U.S. Pat. No. 3,092,892, issued to Ryan on June 11, 1963, except that larger spinnerets having holes in a multi-ring pattern instead of a single-ring pattern are used. The 18 dtex spun filaments are combined to form 470,000 dtex ropes and draw-extracted in a series of 95° C. water baths to 400% of their as-spun length. Two of these drawn, unrelaxed ropes are combined and mechanically crimped at 74° C. to about 4 crimps per extended cm. The crimped wet rope is divided into three tows which are piddled onto a moving, perforated belt and (A) dried 6.9 minutes in a current of 135° C. air, (B) dried 15 minutes in a current of 60° C. air or (C) steamed while wet one minute at atmospheric pressure and dried 15 minutes in a current of 70° C. air. Under these conditions the water content would be expected to be less than about 2% by weight. Results are:

| | Crimp Index | Crimp/cm | ECR* 70 | Filament Density (g/cc) | Filament Entanglement Value |
|---|---|---|---|---|---|
| A | 10.8 | 6.1 | 30.4 ± 2.6 | 1.178 | 6.9 |
| B | 24.1 | 7.6 | 47.7 ± 1.4 | 1.150 | 35.6 |
| C | 17.6 | 8.1 | 45.3 ± 1.9 | 1.147 | 13.5 |

*Mean values of 100 determinations each, with 95% confidence limits

The low-temperature-dried samples B and C (within this invention) developed higher crimp indices and ECRs than Comparative Sample A dried at high temperature. Sample A could not be spread into a split-free, uniform web of even twice its width either by hand or mechanically. However, the interfilament entanglements of tows B and C enabled them to be spread into a split-free, uniform web of more than ten times the tow width. For a further comparison, a commercial nonbonded conventional polyester tow (Fortrel 7) has a filament entanglement value of less than about 1.

Tow C shortened to about half its original length and more than doubled in width (to about 18 cm) as the result of crimp development during the steaming and drying steps. A coherent, split-free, 1.25 m-wide web was easily prepared from this tow. Working of the tow (by stretching to about 150% of its length then relaxing) during or after drying loosened the structure sufficiently to make it laterally stretchable to a width of 2½ m.

The unbonded webs of tows B and C are strong, not only in the length, but also in the width direction, due to strong interfilament entanglements. Fiber directionality in the webs appeared largely random with 45° orientation somewhat predominating. Webs of tows B and C have omnidirectional strength and elasticity. The bicomponent filament crimp between entanglements confers flexibility and drape as well as elasticity. Lamination of several such webs followed by needling or other interlaminate bonding provides felt-like structures.

COMPARATIVE EXAMPLE B

This comparison illustrates the inadequacy of bicomponent fibers having too low an ECR (i.e., too low a differential in the water swellability of the components, even though the density is within the appropriate range.)

A 24% solution of a 90/10 mixture in dimethylformamide of (I) a polyacrylonitrile polymer having an intrinsic vicosity of 2 and (II) a terpolymer having an intrinsic viscosity of 1.4 and containing 94% acrylonitrile, 5.9% methyl acrylate and 0.1% of sodium styrenesulfonate and a 33% solution of the terpolymer in dimethylformamide are processed into side-by-side bicomponent filaments as in Example 1, except that the filaments, which are 8.3 dtex as spun, are drawn to 230% of their as-spun length. The drawn and crimped rope is divided and one tow (1) is dried at 140° C. for 15 minutes while the other tow (2) is dried at 60° C. for one hour. Filaments having a density of 1.170 g/cc and 1.145 g/cc, respectively, are obtained. The 140° C.-dried filaments have an ECR of 6.4±3.4%, and the 60° C.-dried filaments have an ECR of 4.0±1.5%. In neither case are the filaments sufficiently interentangled to permit spreading of the tow to a light web with good lateral cohesion as shown by low filament entanglement values of 7.9 and 10.9, respectively.

COMPARATIVE EXAMPLE C

This comparison illustrates the effect of high fiber density even though the ECR may be within the appropriate range.

Tows prepared as described in Comparative Sample A and in Comparative Example B (well-compacted, high-temperature-dried tows) are drawn to 225% and 405% of their crimp-free lengths, respectively, by being tensioned to remove their crimp and then passed between 155° C. plates on a Turbo Stapler from which the breaker bars are removed. The density of the filaments in the tows is measured before and after drawing. The tabulated results compare these products with the original undrawn tows:

| | Tows from | | | |
|---|---|---|---|---|
| | Comparative Sample A | | Comparative Example B(1) | |
| Turbo stapler draw | 225% | none | 405% | none |
| Density (g/cc) | 1.190 | 1.193 | 1.182 | 1.178 |
| ECR (%) | 25.2 ± 2.0 | 22.3 ± 3.3 | 9.1 ± 2.6 | 4.0 ± 2.9 |

In no case did the tows exhibit the lateral cohesiveness characteristic of the fiber tows of this invention. The high temperature heating consolidated the filaments and high density products resulted. Therefore, by contrast to the tows of the invention, the filaments in the tows of this comparison which are straight after hot-stretching, require boil-off to develop any crimp or entanglement. However, even when ECR was above 20%, the degree of entanglement developed upon boil-off was too low to give the lateral cohesiveness characteristic of the tows of this invention.

| | Tows from | | | |
|---|---|---|---|---|
| | Comparative Sample A | | Comparative Example B(1) | |
| Crimps/cm (boiled off) | 5.6 | 6.6 | 10.1 | 5.6 |
| Crimp Index (boiled off) | 25.8 | 28.1 | 21.6 | 18.5 |
| Filament Entanglement Value (boiled off) | 10.7 | 11.7 | 2.0 | 6.6 |

Although the invention has been described in considerable detail in the foregoing, it is to be understood that such detail is solely for the purpose of illustration and that variations can be made therein by those skilled in the art without departing from the spirit and scope of the invention.

What is claimed is:

1. A process for preparing a spreadable tow of highly entangled continuous acrylic filaments from a tow of 10,000 or more previously undried bicomponent acrylic filaments having a large difference in the hot water swellability of the components by drying the tow to a maximum water content of 3% by weight at a temperature below the hot wet glass transition temperature of the polymers in the filaments, wherein one component of the filaments is selected from the group consisting of polyacrylonitrile and mixtures of polyacrylonitrile and up to 20% by weight of a copolymer containing 90–98% by weight acrylonitrile units and 2–10% by weight units of styrenesulfonic acid, allyl-sulfonic acid, methallylsulfonic acid, vinyl-sulfonic acid, or their metal, ammonium or amine salts, a vinyl pyridine, vinyl pyrrolidone, acrylamide, methacrylamide, hydroxymethylacrylamide or mixtures of any of these units and the other component is a copolymer containing 90–98% by weight acrylonitrile units and 2–10% by weight units of styrenesulfonic acid, allyl-sulfonic acid, methallylsulfonic acid, vinyl-sulfonic acid, or their metal, ammonium or amine salts, a vinyl pyridine, vinyl pyrrolidone, acrylamide, methacrylamide, hydroxymethylacrylamide or mixtures of any of these units.

2. Process of claim 1 wherein the tow is dried at a temperature of 50°–70° C.

* * * * *